United States Patent [19]

Cockerham

[11] 4,160,513

[45] Jul. 10, 1979

[54] TOOTHPASTE DISPENSER

[76] Inventor: Terry L. Cockerham, 3105 Canterbury Dr., Bloomington, Ind. 47401

[21] Appl. No.: 849,162

[22] Filed: Nov. 7, 1977

[51] Int. Cl.[2] ..... B67D 5/06

[52] U.S. Cl. ..... 222/181; 222/327; 222/340; 222/387

[58] Field of Search ..... 222/173, 181, 185, 325–327, 222/336–338, 153, 183, 256, 257, 559, 561, 180, 387, 34 D; 184/45 R, 45 A

[56] References Cited

U.S. PATENT DOCUMENTS

| | | | |
|---|---|---|---|
| 2,056,096 | 9/1936 | Etter | 222/181 |
| 2,471,852 | 5/1949 | Bau | 222/326 |
| 2,652,955 | 9/1953 | Crewe | 222/327 |
| 2,684,183 | 7/1954 | Werner | 222/327 |
| 2,758,758 | 8/1956 | Schimpf | 222/327 |
| 2,841,312 | 7/1958 | Bello | 222/181 |

FOREIGN PATENT DOCUMENTS

| | | | |
|---|---|---|---|
| 701809 | 1/1954 | United Kingdom | 222/181 |

*Primary Examiner*—Robert J. Spar
*Assistant Examiner*—H. Grant Skaggs
*Attorney, Agent, or Firm*—Woodard, Weikart, Emhardt & Naughton

[57] ABSTRACT

A wall mountable bracket has an upwardly opening pocket receiving a replaceable cartridge of toothpaste, the cartridge having a bottom outlet and a valve assembly for it. The cartridge is mounted with the dispensing valve at the lower end and the cartridge has an upper end wall movable downward toward the valve for dispensing the contents. A downwardly opening cup is fittingly received over the outside of the cartridge and inside the bracket pocket, and has a spring loaded plunger engaing the upper wall of the cartridge to urge the contents thereof toward the valve. The valve is a knob-operated, sprng-loaded gate valve. The cartridge-valve assembly is disposable as a unit when the contents of the cartridge have been exhausted.

10 Claims, 4 Drawing Figures

TOOTHPASTE DISPENSER

BACKGROUND OF THE INVENTION

Field of the Invention

This invention relates generally to dispensers, and more particularly to a paste dispenser having a replacable disposable cartridge with built-in valve assembly and movable end wall to urge the contents toward the valve.

Description of the Prior Art

Varieties of toothpaste dispensers have been conceived. Many of them employ some sort of means for mounting a tube of toothpaste, and using a roller or slider to squeeze paste from the uncapped end of the tube. Others involve simply valves for toothpaste tubes. Also there are dentifrice dispensers which have rigid walls, and valves at or near the lower end of the dispenser from which the dentifrice can be taken. Some U.S. patents disclosing some of the aforementioned types of dispensers for dentifrice or other materials were noted in the course of searches for the present invention and are as follows:

| U.S. Pat. No. | Inventor | Issue Date |
|---|---|---|
| 1,209,805 | Boe | Dec. 26, 1916 |
| 1,335,700 | Price | Mar. 30, 1920 |
| 2,141,572 | Tucker | Dec. 27, 1938 |
| 2,596,592 | Parker | May 13, 1952 |
| 2,637,468 | Wekerle | May 5, 1953 |
| 2,659,517 | Reinhardt, Jr. | Nov. 17, 1953 |
| 3,684,183 | Werner | July 20, 1954 |
| 2,721,004 | Schultz | Oct. 18, 1955 |
| 3,087,653 | Nolin | Apr. 30, 1963 |
| 3,132,772 | Bristow | May 12, 1964 |
| 3,580,429 | Trindle | May 25, 1971 |
| 3,640,431 | Plumer | Feb. 8, 1972 |
| Re. 28120 | Plumer | Aug. 20, 1974 |

Referring briefly to these patents, the Reinhardt, Jr. Nolin and Werner patents disclosed spring-biased cartridges of paste material, the Werner patent being specifically for a dentifrice. Bristow also shows a dentifrice dispenser having an axially movable plunger in it and a bracket-mounted valve covering the dispenser outlet. Wekerle also discloses a toothpaste dispenser which is a rigid-walled permanently installed unit with a manually operable valve closing the bottom located outlet.

Trindle shows a paste dispenser having interchangeable cartridges in a bag form. The valve is mounted on the permanent part of the dispenser itself. The Boe and Price patents disclose tape reel indicating means for contents of a dispensing container. The remaining patents in the above list are of interest for their disclosure of cartridge or tube structures having integral valves and which are not dependent on a wall bracket for the valve, the Tucker, Parker and Schultz patents disclosing hand-squeezable tubes with valves in or at the caps, and the Plumer patents showing caulking cartridges with valves therein to prevent drooling of the caulking compound after release of force from the plunger.

There has remained a need for a convenient, sanitary and reliable dispenser for toothpaste. The present invention is directed toward meeting that need.

SUMMARY OF THE INVENTION

Described briefly, in a typical embodiment of the present invention, a wall-mounting bracket is provided with an upwardly opening pocket to receive therein a disposable toothpaste cartridge having a manually operable valved outlet at the lower end thereof for dispensing paste therefrom. A movable upper end wall is provided. A cover cup which is downwardly opening, secured in the bracket, and as a built-in, downwardly urged plunger engaging the movable end of the cartridge, serves to urge the cartridge contents toward the dispensing valve thereon. The cover has quick-release retaining means therein, cooperating with mating means in the bracket to facilitate removal of an exhausted cartridge.

DESCRIPTION OF THE PREFERRED EMBODIMENT

Figure 1:
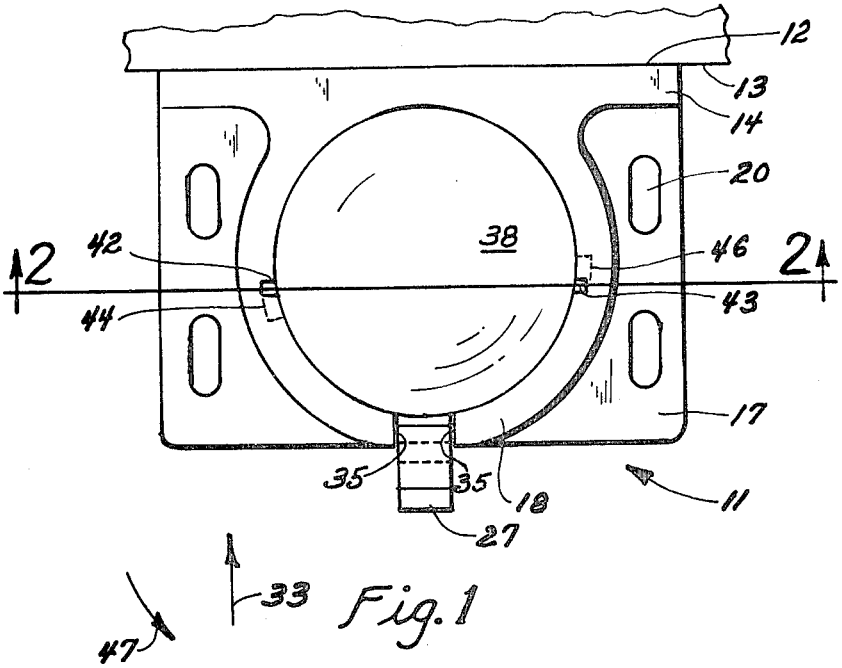
FIG. 1 is a top plan view of a toothpaste dispenser according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, in which FIG. 1 is drawn to a somewhat smaller scale than the other figures, a wall-mounting bracket 11 is provided with an upstanding wall-mounting surface 12 at the rear which can be mounted to a wall surface 13 of a building, for example. The bracket has the wall-mounting portion 14 better shown in FIG. 2 and which has four (4) apertures 16 therein for receipt of screws or other fasteners for mounting to the wall surface 13. The bracket has a horizontal base flange 17 which serves as a base for an upwardly opening pocket 18 which is generally cylindrical and best shown in FIG. 1. Although the portion 18 of the pocket above the base flange 17 is cylindrical, the bottom portion 19 of the pocket below the flange 17 is spherical on both its outer and inner surfaces, the latter serving to support the lower spherical end wall 21 of the toothpaste containing cartridge which has a cylindrical wall 22 extending upwardly from the end 21. Apertures 20 in flange 17 can receive toothbrush handles for convenient storage thereof, if desired.

The cartridge has a round dispensing outlet aperture 23 at the lower end thereof in the center of a valve mounting and guiding outlet boss portion 24. A valve gate 26 is slidably mounted in the boss 24 and has a manual operating knob 27 at the outer end thereof. It has a hole 28 substantially centrally located therein.

Figure 3:
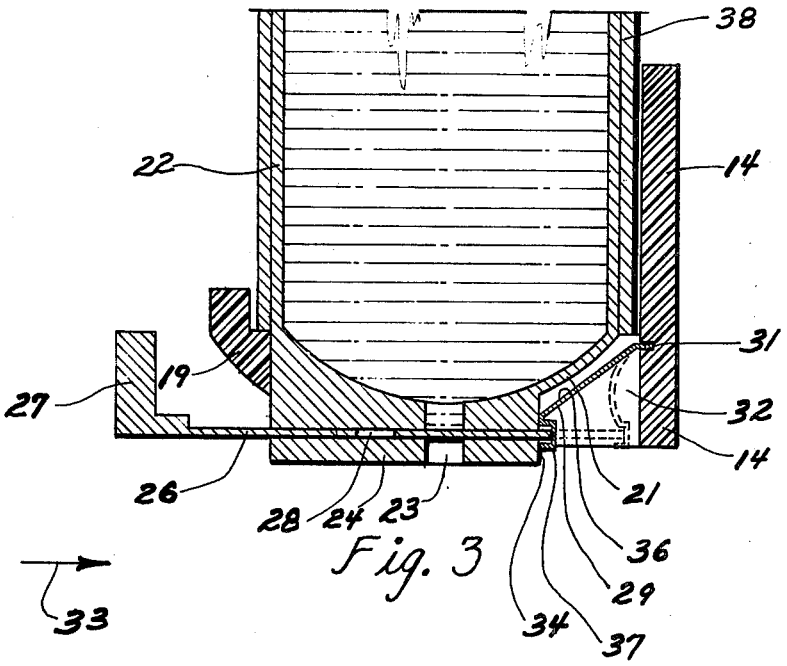
FIG. 3 is a section taken at line 3—3 in FIG. 2 and viewed in the direction of the arrows.
Figure 4:
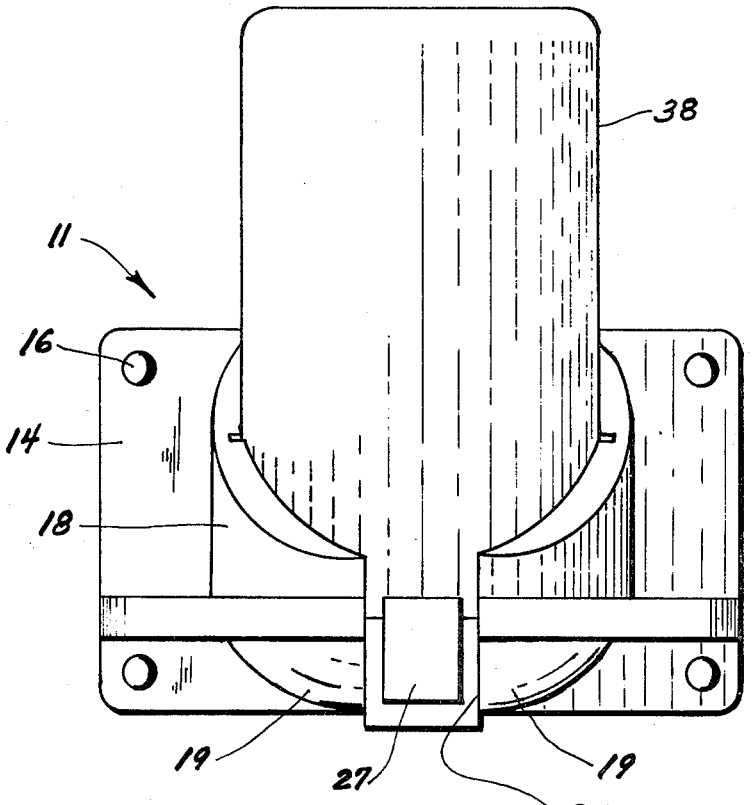
FIG. 4 is front elevational view thereof.

A leafspring 29 is mounted in a groove 31 at the rear end of a radially extending slot 32 in the mounting bracket 11 between portion 19 and portion 14 thereof. This spring 29 normally urges the valve outward to the position shown in the solid lines in FIG. 3 whereupon the hole 28 is out of registry with the hole 23. By pushing the valve gate 26 in the direction of arrow 33 against the bias of the spring, so that the valve is in the position shown by the dotted lines in FIG. 3, the hole 28 will be placed in registry with the aperture 23 whereupon the contents of the cartridge can be dispensed through the outlet 23. Upon release of manual force from the knob 27, the spring 29 will return the gate to the position shown and stop when the lower end of the spring reaches the abutment surface 34 of the valve boss 24 in the cartridge.

From the foregoing description, it can be seen that the cartridge rests with the outlet end down in the pocket of the bracket. Because the bracket is slotted at 35, with the slot extending radially both outward from the vertical center line of the pocket and inward from the vertical center line of the pocket toward the mounting surface 12, there is room for easy insertion of the cartridge from the top, and accommodation not only of the valve knob and gate portion 26, but also accommodation of the mounting boss 24 and the rear end of the gate 26. That end can be inserted easily by camming downward against the sloping upper surface 36 of the spring 29 as the cartridge is downwardly inserted in the unit. In order to free the gate end from the groove 37 in the spring 29 at the lower end of the spring, the knob can be simply pulled slightly forward opposite the direction of arrow 33 (FIG. 3) to remove the rear end of the gate from the spring groove 37 at the lower end of spring 29, whereupon the cartridge can be readily lifted vertically out of the bracket pocket.

Figure 2:
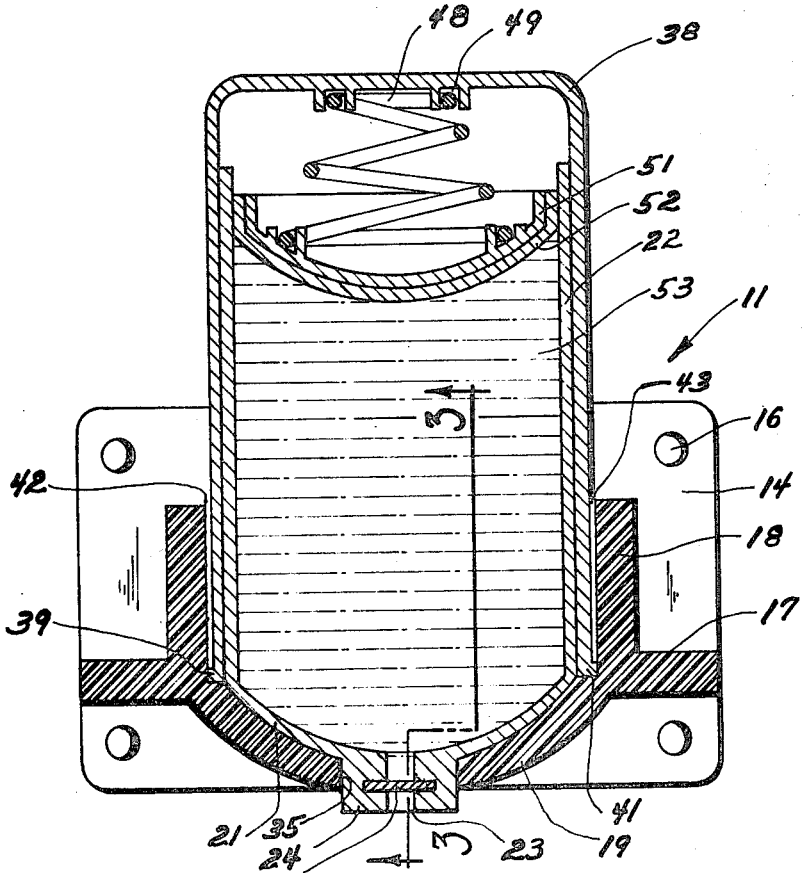
FIG. 2 is a section taken at line 2—2 in FIG. 1 and viewed in the direction of the arrows, and showing the device on a slightly larger scale than FIG. 1.

A cartridge cover 38 is provided and has a pair of diametrically oppositely directed lugs 39 and 41 at the lower open end thereof (FIG. 2). These lugs are received in vertically extended slots 42 and 43 of the bracket pocket 18. At the lower end of the slots there are horizontally extending circumferential grooves as at 44 and 46 enabling the cover cup 38 to be locked in the pocket by a short twist of the cup in the direction of the arrow 47 (FIG. 1). This enables the coil spring 48 which is received in the circumferential groove 49 of the cup to urge the spherical plunger or follower 51 (attached to the lower end of the spring) in a downward direction against the downwardly movable spherical upper end wall 52 of the cartridge. Accordingly, when the cartridge has been placed in the bracket pocket, and the cover pushed down into the pocket until the lugs 41 and 39 are received and locked in the key slots 46 and 44, respectively, at the bottom of the keyways 42 and 43, the spring 48 will have been compressed by the plunger 51; having been moved relatively upward in the cup 38 from the lower end adjacent the lugs to the position shown in FIG. 2. As a result, it will be applying a very substantial downward force on the paste 53 contained in the cartridge. It follows that, when the knob 27 of the gate valve is pushed in the direction of arrow 33, toothpaste will be dispensed from the cartridge as soon as the holes 28 and 23 in gate 26 and boss 24, respectively, are in registry with each other. Yet, because the valve is a slider valve movable perpendicular to the direction of discharge, the spring 29 will promptly return the valve to the closed position as soon as manual effort is released from the knob 27. The cylindrical flanges extending upwardly from the spherical surfaces of the wall 52 and plunger 51 aid in guiding and control of the wall and plunger, as paste is dispensed.

The amount of contents in the container remaining in the cartridge can be registered by suitable gauging means associated with the plunger 51. The aforementioned Boe patent is one example of a type of gauge which could be employed.

The bracket itself, the cartridge, plunger, gate valve and the cartridge cover may be made preferably of a plastic material. The coil spring and leaf spring may be preferably made of metal. Nevertheless, it may be found that other materials would also be suitable in these applications.

It should be recognized that the present invention provides a convenient, reliable and sanitary means for dispensing toothpaste, particularly considering that the valve assembly is part of the disposable cartridge itself. Thus each replacement cartridge will have a clean, new and fresh valve assembly. Upon removal of the cover, the coil spring and plunger remain integral with it so that the cartridge can be readily discarded and a new cartridge inserted without handling the plunger or the coil spring. Only the new cartridge and the exterior of the housing need be touched at all.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A dispenser comprising:

a bracket for mounting to a support;

an elongated cup having an open end received in said bracket, with locking means thereon for locking said cup to said bracket, said cup having a plunger longitudinally movable therein, and biasing means urging said plunger toward the open end of said cup;

a disposable cartridge of material to be dispensed, said cartridge being disposed in said cup, and said cartridge and bracket having cooperating means for reception and support of said cartridge in said bracket, said cartridge having an outlet for material to be dispensed, and said cartridge having a manually operable valve associated with said outlet and operable, when manually actuated, to open said outlet for dispensing said material from said cartridge, said valve being attached to said cartridge independent of said bracket;

said cartridge having a movable wall engaged by said plunger when said cartridge is in said cup and supported by said bracket, said movable wall being urged by said plunger toward said outlet to pressurize said material for discharge when said valve is actuated to open said outlet.

2. The dispenser of claim 1 wherein:

said bracket is upwardly opening and has a cup receiver portion with key slots in an inner wall thereof; and said cup is downwardly opening and said locking means are lugs receivable in said key slots for turn-and-lock of said cup therein; and said bracket has a horizontally opening slot to receive an outlet boss and valve operator of said cartridge.

3. The dispenser of claim 1 wherein:

said valve includes a slideable gate and a manual knob on said gate for actuation thereof between a shut position and an open position thereof.

4. The dispenser of claim 3 and further comprising:

a return spring on said gate urging it towards shut position.

5. The dispenser of claim 4 wherein:

said material is toothpaste.

6. The dispenser of claim 4 wherein:

said bracket has a wall-mounting surface.

7. The dispenser of claim 6 wherein:

said bracket has a circular, cup receiver portion therein with a radially opening slot therein diametrically opposite to said wall-mounting surface, to receive a outlet boss and valve operator of said cartridge.

8. The dispenser of claim 4 wherein said bracket and cup are made of plastic.

9. The dispenser of claim 4 wherein:

said cup is cylindrical;

said cartridge is cylindrical;

said cartridge movable wall is spherical, with a cylindrical guide wall portion extending upwardly therefrom in contact with the inner cylindrical wall of said cartridge; and said plunger is spherical, with a cylindrical guide wall extending upwardly therefrom adjacent said cylindrical guide wall portion of said movable wall of said cartridge.

10. The dispenser of claim 1 wherein:

said cup is cylindrical;

said cartridge is cylindrical;

said plunger is circular and is spring loaded toward the open end of said cup and is slideable axially in said cartridge as it moves said plunger toward said outlet, whereby material is pushed toward said outlet.

* * * * *